US007411142B2

(12) United States Patent
Jung et al.

(10) Patent No.: US 7,411,142 B2
(45) Date of Patent: Aug. 12, 2008

(54) KEYPAD WITH LIGHT GUIDE LAYER, KEYPAD ASSEMBLY AND PORTABLE TERMINAL

(75) Inventors: Sun-Tae Jung, Anyang-si (KR); Joo-Hoon Lee, Yongin-si (KR); Kyoung-Youm Kim, Seoul (KR)

(73) Assignee: Samsung Electronics Co., Ltd., Maetan-Dong, Yeongtong-Gu, Suwon-Si, Gyeonggi-Do (KR)

( * ) Notice: Subject to any disclaimer, the term of this patent is extended or adjusted under 35 U.S.C. 154(b) by 0 days.

(21) Appl. No.: 11/367,610

(22) Filed: Mar. 3, 2006

(65) Prior Publication Data

US 2006/0254894 A1 Nov. 16, 2006

(30) Foreign Application Priority Data

May 13, 2005 (KR) ..... 10-2005-0040177

(51) Int. Cl.
*H01H 9/00* (2006.01)

(52) U.S. Cl. ..... 200/314

(58) Field of Classification Search ..... 200/314
See application file for complete search history.

(56) References Cited

U.S. PATENT DOCUMENTS 5,573,107 A * 11/1996 Nakano et al. ..... 200/314
6,299,320 B1 * 10/2001 Kato et al. ..... 362/23
6,747,226 B2 * 6/2004 Watanabe ..... 200/520
6,861,600 B1 3/2005 Schulz et al. ..... 200/310
6,878,892 B2 * 4/2005 Miyako et al. ..... 200/310
6,886,956 B2 * 5/2005 Parker et al. ..... 362/29
2003/0095398 A1 5/2003 Parker et al.

FOREIGN PATENT DOCUMENTS

| | | |
|---|---|---|
| DE | 8510863 | 5/1985 |
| DE | 3628781 | 3/1987 |
| JP | 2001-167655 | 6/2001 |
| JP | 2003-178639 | 6/2003 |
| JP | 2003-308752 | 10/2003 |

* cited by examiner

*Primary Examiner*—Elvin Enad
*Assistant Examiner*—Lheiren Mae A Anglo
(74) *Attorney, Agent, or Firm*—Cha & Reiter, LLC

(57) ABSTRACT

Disclosed is a keypad which can realize uniform and bright illumination, small power consumption and low manufacturing cost. The keypad includes a light guide layer through which light travels, at least one key button disposed on an upper surface of the light guide layer, a lower elastic layer disposed on a lower surface of the light guide layer, located opposite the upper surface, and at least one reflective pattern formed on the light guide layer and partially reflecting light traveling through the light guide layer toward the key button.

23 Claims, 4 Drawing Sheets

KEYPAD WITH LIGHT GUIDE LAYER, KEYPAD ASSEMBLY AND PORTABLE TERMINAL

CLAIM OF PRIORITY

This application claims the benefit of the earlier filing date of that patent application entitled "Keypad with Light Guide Layer, Keypad Assembly and Portable Terminal" filed in the Korean Intellectual Property Office on May 13, 2005, and assigned Ser. No. 2005-40177, the contents of which are hereby incorporated by reference.

BACKGROUND OF THE INVENTION

1. Field of the Invention

The present invention relates to a keypad with which a portable terminal or the like is provided, and more particularly to a keypad with a light guide layer, and a keypad assembly.

2. Description of the Related Art

A keypad used in a conventional portable terminal generally includes a plate-like elastic pad, a plurality of key buttons which are formed on a first side of the elastic pad, and each of which has characters (letters, numerals or symbols) printed on its upper surface, and a plurality of protrusions (or actuators) formed on a second side of the elastic pad, located opposite the first side. Also, it is normal for the portable terminal to have a plurality of light emitting devices (usually 15 to 20 in number) for backlighting the keypad.

FIG. 1 illustrates a sectional view of a keypad assembly of the prior art. The keypad assembly 100 includes a keypad 110, a switch board 150 and a plurality of light emitting diodes (hereinafter referred to as "LED") 170.

The keypad 110 includes a plate-like elastic pad 120, a plurality of key buttons 140 which are formed on a first side 122 of the elastic pad 120 and each of which has characters (letters, numerals or symbols) printed on its upper surface, and a plurality of protrusions 130 formed on a second side 124 of the elastic pad 120, located opposite the first side 122. Each protrusion 130 on the second side 124 of the elastic pad 120 is arranged in a position corresponding to a center of each key button 140. A plurality of grooves 126 may be formed on the second side 124 of the elastic pad 120. The grooves 126 are disposed around the respective protrusions 130 so as to avoid interferences between the light emitting diodes 170 and the protrusions 130.

The switch board 150 has a plate-like printed circuit board (hereinafter referred to as "PCB") 155 and a plurality of switches 160 formed on an upper surface, facing the keypad 110, of the PCB 155. Each switch 160 consists of an electrically conductive contact member 162 and an electrically conductive dome 164 completely covering the contact member 162.

The plurality of light emitting diodes 170 are mounted on the upper surface of the PCB 155, and are positioned such that each of them is covered with a corresponding groove 126 of the elastic pad 120.

If a user pushes down any one key button 140, a portion of the keypad 110, located under the key button 140, is deformed onto the switch board 150, and, thus, a corresponding protrusion 130 belonging to the deformed portion of the keypad 110 presses a corresponding dome 164. The pressed dome 164 comes into electrical contact with a corresponding contact member 162.

For operating the switches 160, each light emitting diode 170 may not be located under the corresponding key button 140. Thus, light emitted from each light emitting diode 170 obliquely illuminates the corresponding key button 140 after passing through the elastic pad 120. On this account, there is a problem in that the key button 140 is not uniformly illuminated. In other words, a central portion of each key button 140 is relatively darkly illuminated whereas edge portions of the key button 140 are relatively brightly illuminated. Also, even if a greater number of light emitting diodes are provided so as to uniformly and brightly illuminate the key buttons 140, there occurs a further problem of large power consumption and high manufacturing cost.

To solve these problems, a method is proposed to use inorganic EL (Electro Luminance) for illuminating key buttons. However, the inorganic EL requires an additional inverter for converting DC current to AC current because AC power must be used for the inorganic EL, and electric noise and sound noise occurring in the inorganic EL must be settled beforehand.

SUMMARY OF THE INVENTION

Accordingly, the present invention has been made to solve at least the above-mentioned problems occurring in the prior art and provides additional advantages, by providing a keypad, a keypad assembly and a portable terminal, which can realize uniform and bright illumination, small power consumption and low manufacturing cost.

In one embodiment, there is provided a keypad comprising a light guide layer into which light travels, at least one key button being disposed on an upper surface of the light guide layer, a lower elastic layer being disposed on a lower surface of the light guide layer, located opposite the upper surface, and at least one reflective pattern being formed on the light guide layer and partially reflecting the light traveling into the light guide layer toward the key button.

In another embodiment, there is provided a keypad assembly comprising a keypad including a light guide layer into which light travels, at least one key button being disposed on an upper surface of the light guide layer, a lower elastic layer being disposed on a lower surface of the light guide layer, located opposite the upper surface, and at least one reflective pattern being formed on the light guide layer and partially reflecting the light traveling into the light guide layer toward the key button, and a switch board being provided, on an upper surface thereof facing the keypad, with at least one switch, wherein as the key button is pushed down, a portion of keypad is deformed onto the switch to press the switch.

In another embodiment, there is provided a keypad assembly comprising a switch board being provided on an upper surface thereof with at least one switch, a keypad including a light guide layer having an upper surface, a lower surface and side surfaces, and at least one key button being disposed on the upper surface of the light guide layer while being positioned above the switch, at least one light emitting device being disposed adjacent to at least one of the side surfaces of the light guide layer, a lower elastic layer being disposed on a lower surface of the light guide layer, located opposite the upper surface, and at least one reflective pattern being formed on a portion of the upper or lower surface of light guide layer, located under the key button, and partially reflecting the light traveling into the light guide layer toward the key button.

In yet another embodiment, there is provided a portable terminal comprising, a keypad including a light guide layer into which light travels, at least one key button being disposed on an upper surface of the light guide layer, a lower elastic layer being disposed on a lower surface of the light guide layer, located opposite the upper surface, and at least one reflective pattern being formed on the light guide layer and partially reflecting the light traveling into the light guide layer toward the key button, and a switch board being provided, on an upper surface thereof facing the keypad, with at least one switch, wherein as the key button is pushed down, a portion of keypad is deformed onto the switch to press the switch.

BRIEF DESCRIPTION OF THE DRAWINGS

The above features and advantages of the present invention will be more apparent from the following detailed description taken in conjunction with the accompanying drawings, in which.

DETAILED DESCRIPTION

Figure 1:
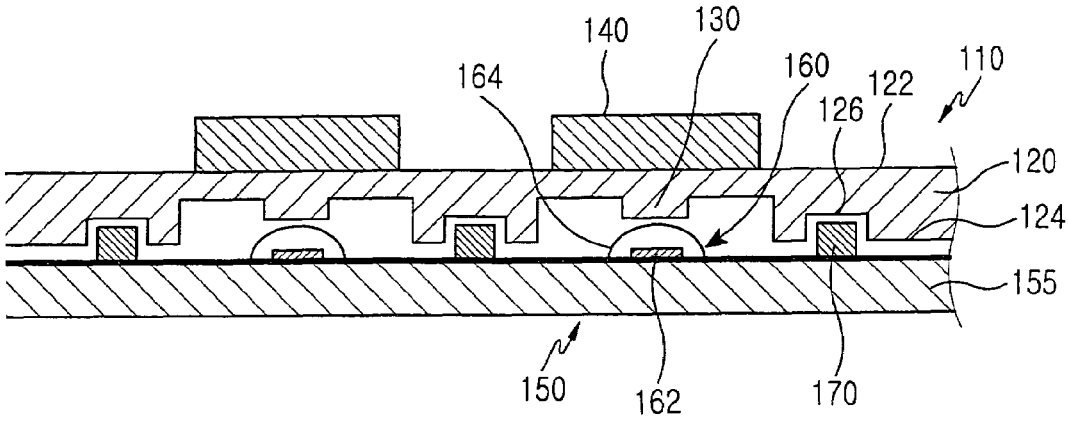
FIG.1 (PRIOR ART)
FIG. 1 is a sectional view of a conventional keypad assembly.

Hereinafter, embodiments of the present invention will be described with reference to the accompanying drawings. It should be noted that the similar components are designated by similar reference numerals although they are illustrated in different drawings. For the purposes of clarity and simplicity, a detailed description of known functions and configurations incorporated herein will be omitted as it may obscure the subject matter of the present invention.

Figure 2:
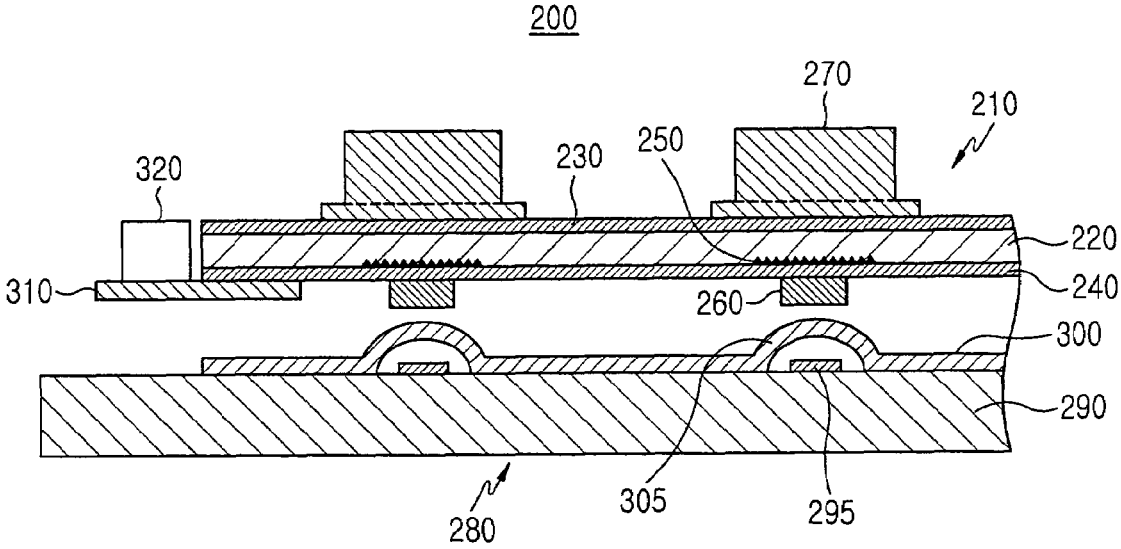
FIG. 2 is a sectional view of a keypad assembly in accordance with a preferred embodiment of the present invention.
Figure 3:
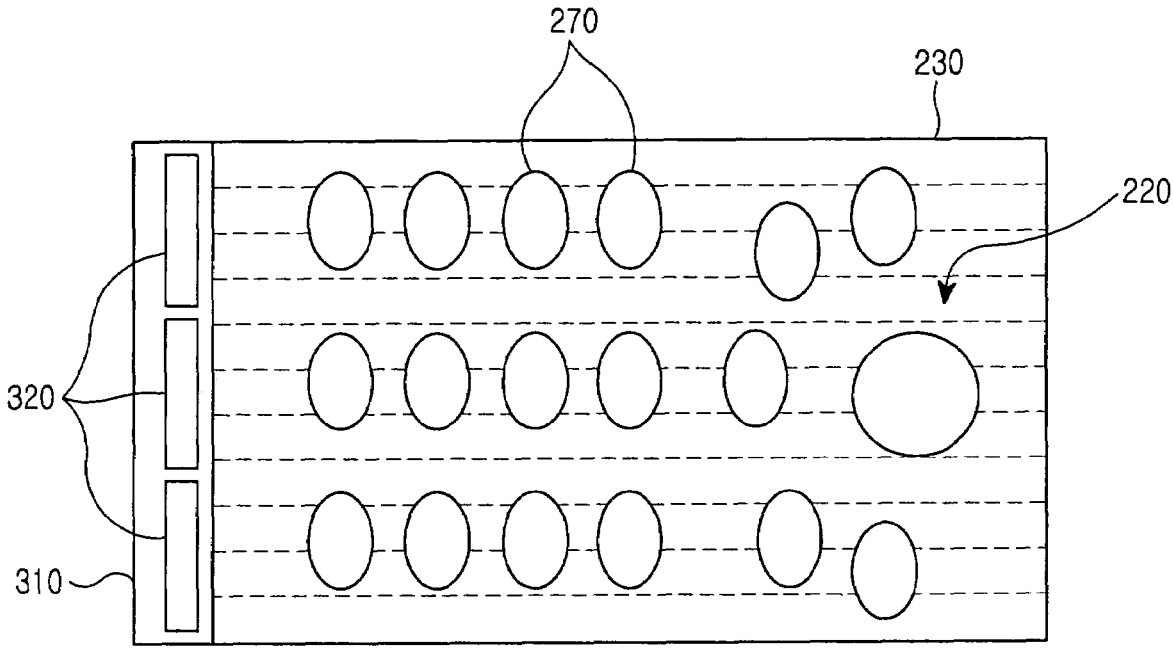
FIG. 3 is a plain view of the keypad assembly shown in FIG. 2.

FIG. 2 illustrates a sectional view of a keypad assembly in accordance with a preferred embodiment of the present invention, and FIG. 3 illustrates the keypad assembly in a plain view.

The keypad assembly 200 includes a keypad 210, a switch board 280 disposed apart from the keypad 210, at least one light emitting device 320, and a second PCB 310.

The keypad 210 includes a light guide layer 220, upper and lower elastic layers 230, 240, a plurality of key buttons 270, a plurality of protrusions 260, and a plurality of reflective patterns 250. In FIG. 3, the light guide layer 220 is shown by a dotted line.

Figure 6A:
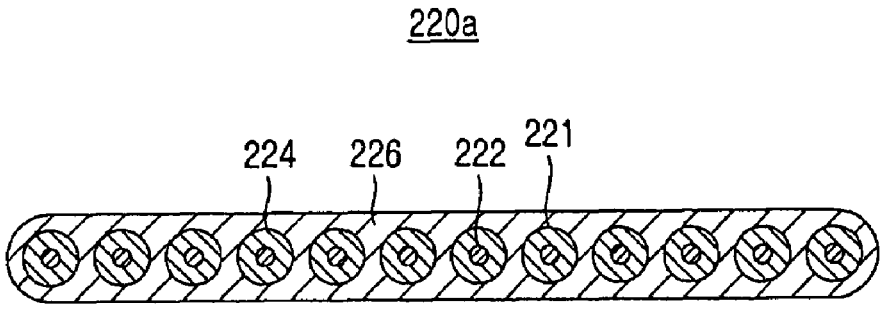
FIG. 6A is a sectional view of a ribbon optical fiber.

The light guide layer 220 guides light coupled into it. The coupled light travels from one side to the other side of the light guide layer 220. As shown in FIG. 6A, the light guide layer may include an optical fiber array 220*a* consisting of a plurality of optical fibers 221, which are arranged side by side in rows and each of which has a core 222 and a cladding 224. Light coupled to the core of each optical fiber travels into the core by virtue of total reflection at an interface between the core and the cladding. A refractive index of the core is larger than that of the cladding. The light guide layer 220 has flexibility —i.e., a property of being easily bent—, so it is locally deformed toward the switch board 280 as the key button 270 is pushed down. Still referring to FIG. 6A, a ribbon optical fiber 220*a* comprises a plurality optical fibers 221, which may be made of glass or plastic, and the optical fibers have a resin coating layer 226 surrounding the optical fibers 221. The light guide layer preferably has a thickness not greater than 0.5 millimeters (mm)(preferably within a range of 0.25 to 0.5 mm).

Figure 6B:
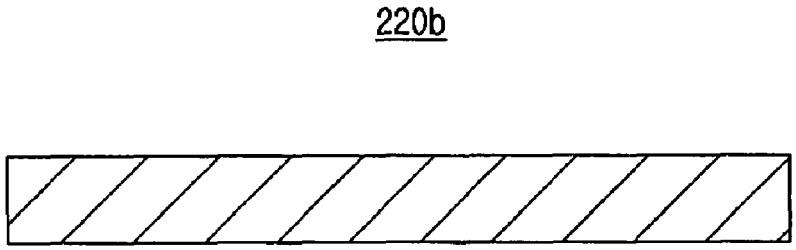
FIG. 6B is a sectional view of an optically transparent film.

As shown in FIG. 6B, the light guide layer 220 may also include an optically transparent film 220*b* having flexibility, and light coupled to the optically transparent film 220*b* travels into the optically transparent film by virtue of total reflection at interfaces between the optically transparent film and the elastic layers 230, 240 external thereto. Otherwise, by adjusting refractive indices of the optically transparent film and upper and lower elastic layers 230, 240 and/or an incident angle of light, light coupled into the keypad 210 may travel into the keypad 210 by virtue of total reflections at interfaces between the upper and lower elastic layers 230, 240 and an air layer external thereto.

The upper elastic layer 230 is attached onto an upper surface of the light guide layer 220 and has a plate-like shape. There is no limitation on the plate-like shape, and the upper elastic layer 230 may have any plate-like shape including a rectangular plate and so forth. Since the upper elastic layer 230 has elasticity, it returns the key button 270 to an original position after the key button 270 is pushed down. That is, the upper elastic layer 230 itself has a restoring force by which it restores its original shape, so it returns the key button 270 to its original position after the key button 270 is operated. The upper and lower elastic layers 230, 240 are made of material having low hardness, a high elastic strain, a high elastic restoring force and high optical transparency so as to provide a good click feeling, to suppress interference phenomena between the key buttons 270, and not to cause permanent deformation in repetitive operation, and are preferably made of polyurethane, silicone or the like.

The plurality of key buttons 270 are formed on an upper surface of the upper elastic layer 230, and letters, numerals and/or symbols are printed on upper surfaces of the key buttons 270. The key buttons 270 may be made of the same material as or of different material from that of the upper elastic layer 230 while forming a one-piece component with the upper elastic layer 230, or may be made of materials such as polycarbonate or acryl-based resin and then be attached onto the upper surface of the upper elastic layer 230. Each key button 230 may be formed in any shape, for example, in the shape of a cylinder, an elliptic cylinder or the like.

The lower elastic layer 240 is attached onto a lower surface of the light guide layer 220, and has a plate-like shape. There is no limitation on the type of the plate-like shape, and the lower elastic layer 240 may have any plate-like shape including a rectangular plate and so forth. Since the lower elastic layer 240 has elasticity, it cooperates with the upper elastic layer 230 to return the key button 270 to its original position after the key button 270 is pushed down.

If the light guide layer 220 has a thickness of 0.2 mm or less (e.g., within a range of 0.1 to 0.125 mm), then only the lower elastic layer 240 may be used while the upper elastic layer 230 is removed. That is, of the upper and lower elastic layers 230, 240 functioning to provide the keypad 210 with a restoring force, the upper elastic layer 230 may be removed when the light guide layer 220 is thin enough to be provided with a sufficient resilient force by only the lower elastic layer 240.

The plurality of protrusions 260 are formed on a lower surface of the lower elastic layer 240. The protrusions 260 may be made of the same material as or of different material from that of the lower elastic layer 240 while forming a one-piece component with the lower elastic layer 240, or may be made of materials such as polycarbonate or acryl-based resin and then be attached onto the lower surface of the lower elastic layer 240. Each protrusion 260 may be formed in any shape, for example, in the shape of a truncated cone, a trapezoidal hexahedron or the like. Each protrusion 260 is aligned under the corresponding key button 270 (in a widthwise direction of the keypad assembly 200 or in a direction perpendicular to an upper surface of a first PCB 290). The size and the shape of each protrusion 260 may be determined in consideration of the size of a dome 305 provided on the switch board 280. For example, when a dome having a width (or diameter) of 5 mm is used, the protrusion may have a width of 2 mm and a thickness of 0.2 to 0.3 mm.

The plurality of reflective patterns 250 are formed on the lower surface of the light guide layer 220, and each of them reflects a portion of the light, traveling into the light guide layer 220, toward the corresponding key button 270. Each reflective pattern 250 is locally formed on the lower surface of the light guide layer 220, and is interposed between the light guide layer 220 and the lower elastic layer 240. Light traveling into the light guide layer 220 by virtue of total reflection is incident to the reflective pattern 250 and is diffuse-reflected toward the key button 270. Since most of the diffuse-reflected light does not satisfy a total reflection condition (that is, an incident angle is smaller than a threshold angle), the light is transmitted through the key button 270 to exit out of the key button 270. Also, light passing by the reflective pattern 250 without being diffuse-reflected, and a part of the diffuse-reflected light, continue to travel through the light guide layer 220 while satisfying the total reflection condition, thereby contributing to the illumination of the other key buttons. In other words, the reflective pattern 250 causes diffuse reflection such that only a part of the incident light is used for illuminating the corresponding key button 270 and the remaining part of the incident light contributes to illuminating the other key buttons. The reflective patterns 250 enable uniform illumination of the key buttons 270 through diffuse reflection in random directions. Preferably, the reflective patterns 250 may be formed by scratching, lasing, forming, printing or the like. When the light guide layer 220 includes an optical fiber array, the reflective patterns 250 extend from a lower surface of the optical fiber array to core surfaces.

The switch board 280 includes a first PCB 290 and a dome sheet 300.

The first PCB 290 has a plurality of electrically conductive contact members 295 formed on its upper surface and a plurality of domes 305 covering the electrically conductive contact members 295. Each pair of the contact member 295 and the corresponding dome 305 constitutes a switch 295, 305. The switch 295, 305 is aligned under the corresponding protrusion 260.

The dome sheet 300 is attached to the upper surface of the first PCB 290, and is provided with the plurality of electrically conductive domes 305 having a hemispherical shape. Each dome 305 completely covers the corresponding contact member 295.

When a user pushes down any one key button 270, a portion of the keypad 210, located under the key button 270, is deformed onto the switch board 280, and thus a corresponding protrusion 260 belonging to the deformed portion of the keypad 210 presses a corresponding dome 305. The pressed dome 305 comes in electrical contact with a corresponding contact member 295.

The second PCB 310 is attached to an edge portion of the lower surface of the lower elastic layer 240, and at least one light emitting device 320 is mounted on an upper surface of the second PCB 310 while its light emitting surface faces a side surface of the light guide layer 220. Light exiting from the light emitting device 320 is coupled into the light guide layer 220 through the side surface of the light guide layer 220. An ordinary flexible PCB (FPCB) may be used as the second PCB 310, and an ordinary light emitting diode may be used as the light emitting device 320.

Figure 4:
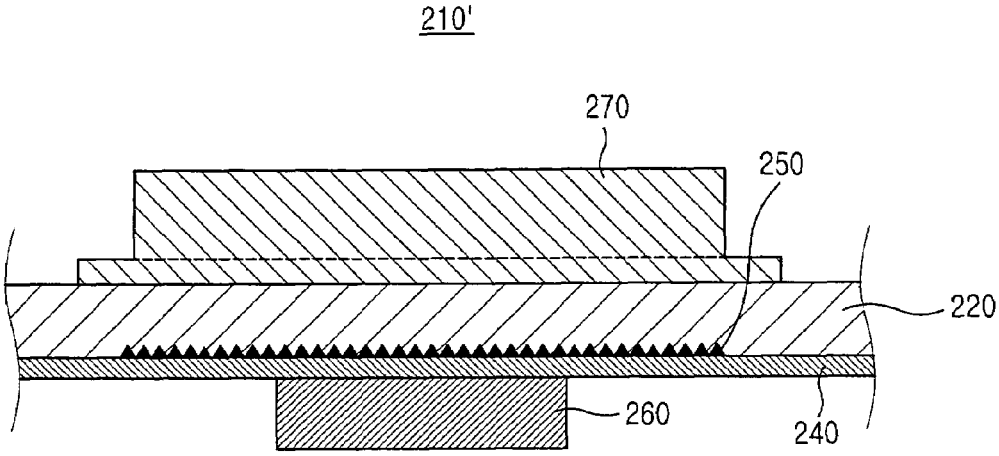
FIG. 4 is a sectional of a keypad in accordance with another preferred embodiment of the present invention.

FIG. 4 illustrates a sectional view of a keypad in accordance with another embodiment of the present invention. The keypad 210' according to this embodiment has a construction in which the upper elastic layer 230 is removed from the keypad 210 shown in FIG. 2. The key buttons 270 are attached on the upper surface of the light guide layer 220. Light traveling into the light guide layer 220 by virtue of total reflection is incident to the reflective pattern 250 and is diffuse-reflected toward the key button 270. Since most of the diffuse-reflected light does not satisfy a total reflection condition (that is, an incident angle is smaller than a threshold angle), the light is transmitted through the key button 270 to exit out of the key button 270. Also, light passing by the reflective pattern 250 without being diffuse-reflected, and a part of the diff-use-reflected light, continue to travel through the light guide layer 220 while satisfying the total reflection condition, thereby contributing to the illumination of the other key buttons.

Figure 5:
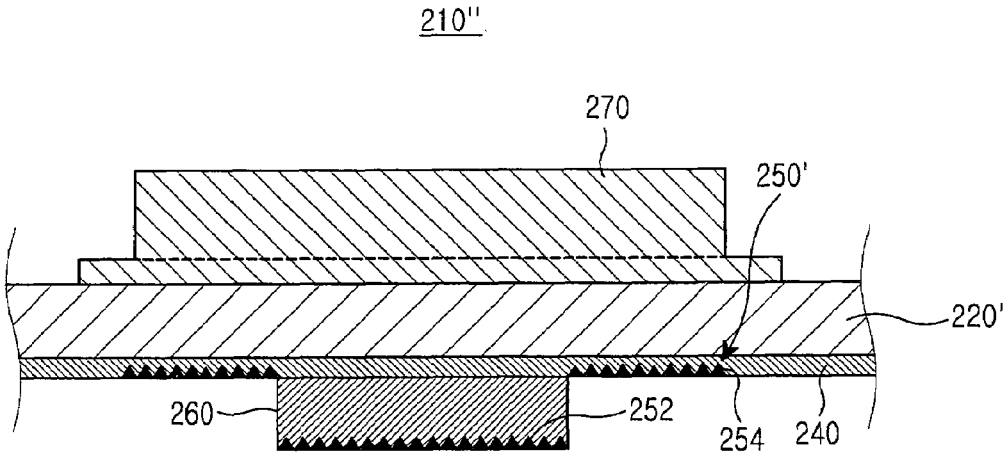
FIG. 5 is a sectional view of a keypad in accordance with another yet preferred embodiment of the present invention.

FIG. 5 illustrates a sectional view of a keypad in accordance with another yet embodiment of the present invention. The keypad 210" according to this embodiment has a construction in which a reflective pattern is positioned differently from that of the keypad 210' shown in FIG. 4. A light guide layer 220' is made of an optically transparent film having flexibility, and light coupled into the keypad 210" travels into the keypad 210" by virtue of total reflections at interfaces between the light guide layer 220' and the lower elastic layer 240 and an air layer external thereto. The reflective pattern 250' consists of a central portion 252 formed on an upper surface of the protrusion 260 and an edge portion 254 formed around the protrusion 260. Light traveling into the keypad 210" by virtue of total reflection is incident to the reflective pattern 250' and is diffuse-reflected toward the key button 270. Since most of the diffuse-reflected light does not satisfy a total reflection condition (that is, an incident angle is smaller than a threshold angle), the light is transmitted through the key button 270 to exit out of the key button 270. Also, light passing by the reflective pattern 250' without being diffuse-reflected, and a part of the diffuse-reflected light, continue to travel through the keypad 210" while satisfying the total reflection condition, thereby contributing to the illumination of the other key buttons.

As described above, a keypad and a keypad assembly according to the present invention have an advantage in that they can uniformly and brightly illuminate the key buttons by means of elastic layers, which have elasticity, and a light guide layer, which has flexibility, provided between key buttons and protrusions. Also, since the keypad and the keypad assembly have the light guide layer, it is possible to reduce the number of necessary light emitting devices, power consumption and manufacturing cost.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A keypad comprising:

a light guide layer into which light travels from one side surface to another side surface of the light guide layer;

at least one key button being disposed on an upper surface of the light guide layer;

a lower elastic layer being disposed on a lower surface of the light guide layer, located opposite the upper surface, wherein the side surfaces of the light guide layer are disposed between the upper and lower surfaces of the light guide layer;

at least one protrusion being formed on a lower surface of the lower elastic layer;

at least one reflective pattern being formed on the light guide layer and partially reflecting the light traveling into the light guide layer toward the key button; and at least one light emitting device positioned to face the one side surface of the light guide layer and adapted to couple light into the light guide layer, wherein the key button, the reflective pattern and the protrusion are aligned along a thickness direction of the keypad.

2. The keypad as claimed in claim 1, further comprising:

an upper elastic layer being disposed on the upper surface of the light guide layer while being interposed between the key button and the light guide layer.

3. The keypad as claimed in claim 1, wherein the reflective pattern is formed on the lower surface of the light guide layer, and is interposed between the light guide layer and the lower elastic layer.

4. The keypad as claimed in claim 1, wherein the reflective pattern causes diffuse-reflection.

5. The keypad as claimed in claim 1, wherein the light guide layer includes an optical fiber any consisting of a plurality of optical fibers, each of which has a core and a cladding, or an optically transparent film.

6. The keypad as claimed in claim 1, wherein the light guide layer includes a ribbon optical fiber consisting of a plurality of plastic optical fibers or glass optical fibers, and a resin coating layer surrounding the plastic optical fibers or the glass optical fibers.

7. The keypad as claimed in claim 1, wherein the lower elastic layer is made of polyurethane or silicone.

8. The keypad as claimed in claim 1, wherein the lower elastic layer returns the key button to its original position after the key button is operated.

9. The keypad as claimed in claim 1, wherein the reflective pattern is centered along a central axis of the key button to uniformly illuminate the key button.

10. The keypad as claimed in claim 1, wherein the light guide layer includes a flexible optically transparent film.

11. A keypad assembly comprising:

a keypad including a light guide layer into which light travels from one side surface to another side surface of the light guide layer;

at least one key button being disposed on an upper surface of the light guide layer;

a lower elastic layer being disposed on a lower surface of the light guide layer, located opposite the upper surface, wherein the side surfaces of the light guide layer are disposed between the upper and lower surfaces of the light guide layer;

at least one protrusion formed on a lower surface of the lower elastic layer;

at least one reflective pattern being formed on the light guide layer and partially reflecting the light traveling into the light guide layer toward the key button;

one light emitting device being disposed in a position facing the one side surface of the light guide layer for coupling light into the light guide layer; and a switch board including at least one switch being formed on an upper surface of the switch board facing the keypad, wherein as the key button is pushed down, a portion of keypad is deformed onto the switch to press the switch, and wherein the key button, the reflective pattern and the protrusion are aligned along a thickness direction of the keypad.

12. The keypad assembly as claimed in claim 11, further comprising:

a printed circuit board being attached to an edge portion of a lower surface of the lower elastic layer, wherein the light emitting device is mounted on an upper surface of the printed circuit board.

13. The keypad assembly as claimed in claim 11, further comprising:

an upper elastic layer being disposed on the upper surface of the light guide layer the upper elastic layer being interposed between the key button and the light guide layer.

14. The keypad assembly as claimed in claim 11, wherein the reflective pattern is formed on the lower surface of the light guide layer, and is interposed between the light guide layer and the lower elastic layer.

15. The keypad assembly as claimed in claim 11, wherein the reflective pattern causes diffuse-reflection.

16. The keypad assembly as claimed in claim 11, wherein the light guide layer includes an optical fiber array consisting of a plurality of optical fibers, each of which has a core and a cladding, or an optically transparent film.

17. The keypad assembly as claimed in claim 11, wherein the light guide layer includes a ribbon optical fiber consisting of a plurality of plastic optical fibers or glass optical fibers, and a resin coating layer surrounding the plastic optical fibers or the glass optical fibers.

18. The keypad assembly as claimed in claim 11, wherein the lower elastic layer is made of polyurethane or silicone.

19. The keypad assembly as claimed in claim 11, wherein the lower elastic layer returns the key button to its original position after the key button is pushed down.

20. The keypad assembly as claimed in claim 11, wherein the reflective pattern is centered along a central axis of the key button to uniformly illuminate the key button.

21. The keypad assembly as claimed in claim 11, wherein the light guide layer includes a flexible optically transparent film.

22. A portable terminal comprising:

a keypad including a light guide layer into which light travels from one side surface to another side surface of the light guide layer;

at least one key button being disposed on an upper surface of the light guide layer;

a lower elastic layer being disposed on a lower surface of the light guide layer, located opposite the upper surface, wherein the side surfaces of the light guide layer are disposed between the upper and lower surfaces of the light guide layer;

at least one protrusion formed on a lower surface of the lower elastic layer;

at least one reflective pattern being formed on the light guide layer and partially reflecting the light traveling into the light guide layer toward the key button;

one light emitting device being disposed in a position facing the one side surface of the light guide layer for coupling light into the light guide layer; and a switch board including at least one switch being formed on an upper surface of the switch board, wherein as the key button is pushed down, a portion of keypad is deformed onto the switch to press the switch, and wherein the key button, the reflective pattern and the protrusion are all aligned along a thickness direction of the keypad.

23. The portable terminal as claimed in claim 22, wherein the reflective pattern is centered along a central axis of the key button to uniformly illuminate the key button.

* * * * *